US005907524A

United States Patent [19]

Marmy et al.

[11] Patent Number: 5,907,524

[45] Date of Patent: May 25, 1999

[54] METHOD FOR MANUFACTURING A BALANCE-SPRING OBTAINED ACCORDING TO SAID METHOD

[75] Inventors: Philippe Marmy, Porrentruy; Eric Favre, Grenchen, both of Switzerland; Christoph Schlencker, Schmiedeberg, Germany

[73] Assignee: Eta Sa Fabriques D'Ebauches, Grenchen, Switzerland

[21] Appl. No.: 09/165,294

[22] Filed: Oct. 2, 1998

[30] Foreign Application Priority Data

Oct. 21, 1997 [CH] Switzerland ..... 2439/97

[51] Int. Cl.[6] ..... G04B 17/04

[52] U.S. Cl. ..... 368/175; 368/178

[58] Field of Search ..... 368/169–178

[56] References Cited

U.S. PATENT DOCUMENTS 3,599,423 8/1971 Beguin ..... 368/171
3,934,403 1/1976 Tilse ..... 368/175
3,958,410 5/1976 Bell ..... 368/175

FOREIGN PATENT DOCUMENTS 1475005 7/1902 France .
636992 7/1983 Switzerland .

*Primary Examiner*—Vit Miska
*Attorney, Agent, or Firm*—Sughrue, Mion, Zinn, Macpeak & Seas, PLLC

[57] ABSTRACT

A method for manufacturing a balance-spring for a clockwork movement wherein a spring is formed by winding, from a wire or metal strip, said spring including an inner end intended to be fixed to a balance and a outer end zone intended to be fixed to the balance-spring stud and wherein the whole spring is subjected to a first heat treatment subsequent to the winding step of said wire. The method of the invention is characterized in that it further includes an additional step consisting in subjecting at least said outer end zone to a second heat treatment.

This method improves in particular the shock resistance of the balance-spring.

9 Claims, 2 Drawing Sheets

METHOD FOR MANUFACTURING A BALANCE-SPRING OBTAINED ACCORDING TO SAID METHOD

Figure 1:
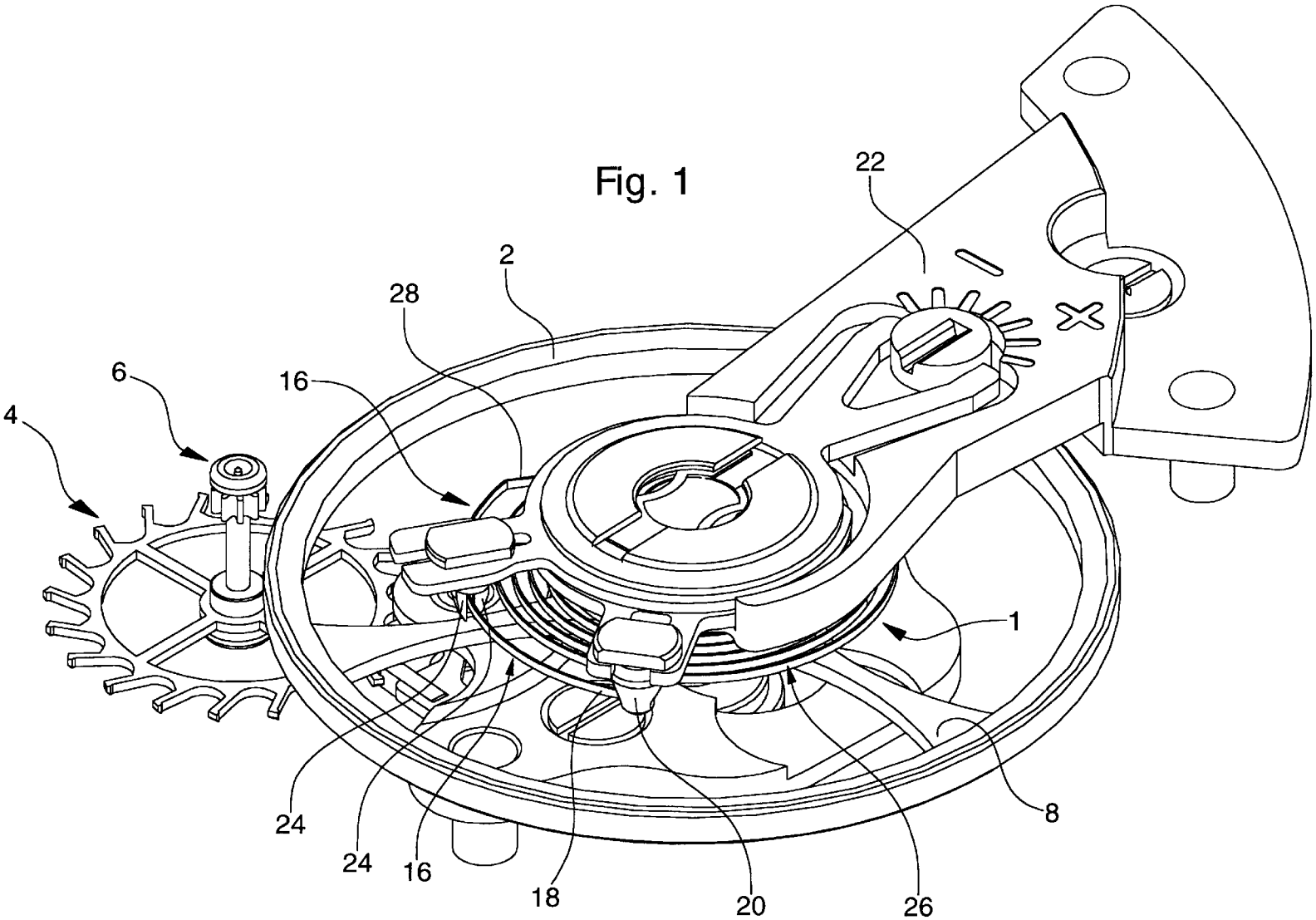

The present invention concerns a method for manufacturing a balance-spring or hair-spring for a clockwork movement and more particularly such a method allowing the sensitivity of the balance-spring to shocks to be decreased. The invention also concerns a balance-spring obtained according to said method.

The accuracy of a watch with a mechanical movement depends essentially on the isochronism of its regulating organ. The latter is formed by the spring and balance assembly. The balance is generally a fly-wheel with two or three arms and the balance-spring is a long coiled metal spring in the shape of a spiral, for example a flat or helical spiral whose turns are equidistant. The balance-spring is fixed to the balance by its inner end via a ring called a collet, which is intended to be adjusted on the shaft of the balance, while the outer end of the balance-spring is attached to a part called a balance-spring stud, fixed onto the balance bridge. Generally, associated with this regulating organ, there is an index or regulator, which is an element carrying pins between which the outer turn of the spring passes before being pinned to the stud. The index allows the daily rate or working of the watch to be modified by lengthening or shortening the active length of the spring by acting on the points of contact of the outer turn with the pins.

The shock sensitivity of this regulating organ has long been a problem which remains without a satisfactory solution. Any shock which the watch undergoes can lead to deformation of the turns, leading to a loss of the concentricity thereof, or even, for the penultimate outer turn, contact with the balance-spring stud. In all cases this causes significant disruptions to the working and amplitude of the balance and consequently to a loss of its regulating qualities.

A principal object of the invention is thus to overcome the drawbacks of the aforementioned prior art by providing a method for manufacturing a balance-spring which gives the spring improved shock resistance. Another object of the invention is to provide a balance-spring with reduced shock sensitivity without significantly increasing the cost price thereof.

The invention therefore concerns a method for manufacturing a balance-spring for a clockwork movement wherein a spring is formed by winding, from a wire or metal strip, said spring including an inner end intended to be fixed to a balance and an outer end zone intended to be fixed to the balance-spring stud and wherein the whole spring is subjected to a first heat treatment subsequent to the winding step of said wire, the method being characterized in that it further includes an additional step consisting in subjecting at least said outer end zone to a second heat treatment.

This method allows the release of the inner stress of the material forming the spring caused by cold deformation of the spring when wound and in particular the portion of the outer turn situated in proximity to the collet spring and the stud attached to the balance bridge, so that the permanent deformation resistance of the spring following a shock is improved.

According to a preferred embodiment, the balance-spring is made of an alloyed steel and the second heat treatment step consists in heating said zone to a temperature ranging between 500 and 650° C. and preferably between 510 and 550° C.

It will be understood that the treatment temperatures vary within the aforementioned ranges as a function of the composition of the alloy of the balance-spring concerned.

According to a preferred feature of the invention, the zone which undergoes the second heat treatment extends, from the point of fixation of the stud onto the outer turn and towards the interior of the spring on an arc of a circle less than 200° and preferably on an arc of a circle less than 140°.

In any case, the transition zone between the outer turn and the preceding turn will be included in the zone which undergoes the second heat treatment.

The invention also concerns a balance-spring for a clockwork movement formed of a wire or a strip wound in a spiral including an inner end intended to be fixed to a balance and an outer end zone intended to be fixed to a stud, characterized in that at least said zone has an inferior hardness to that of the rest of the spring.

According to a preferred embodiment of the invention, the Vickers hardness of the outer end zone is 10% less than the hardness of the rest of the spring.

Figure 2:
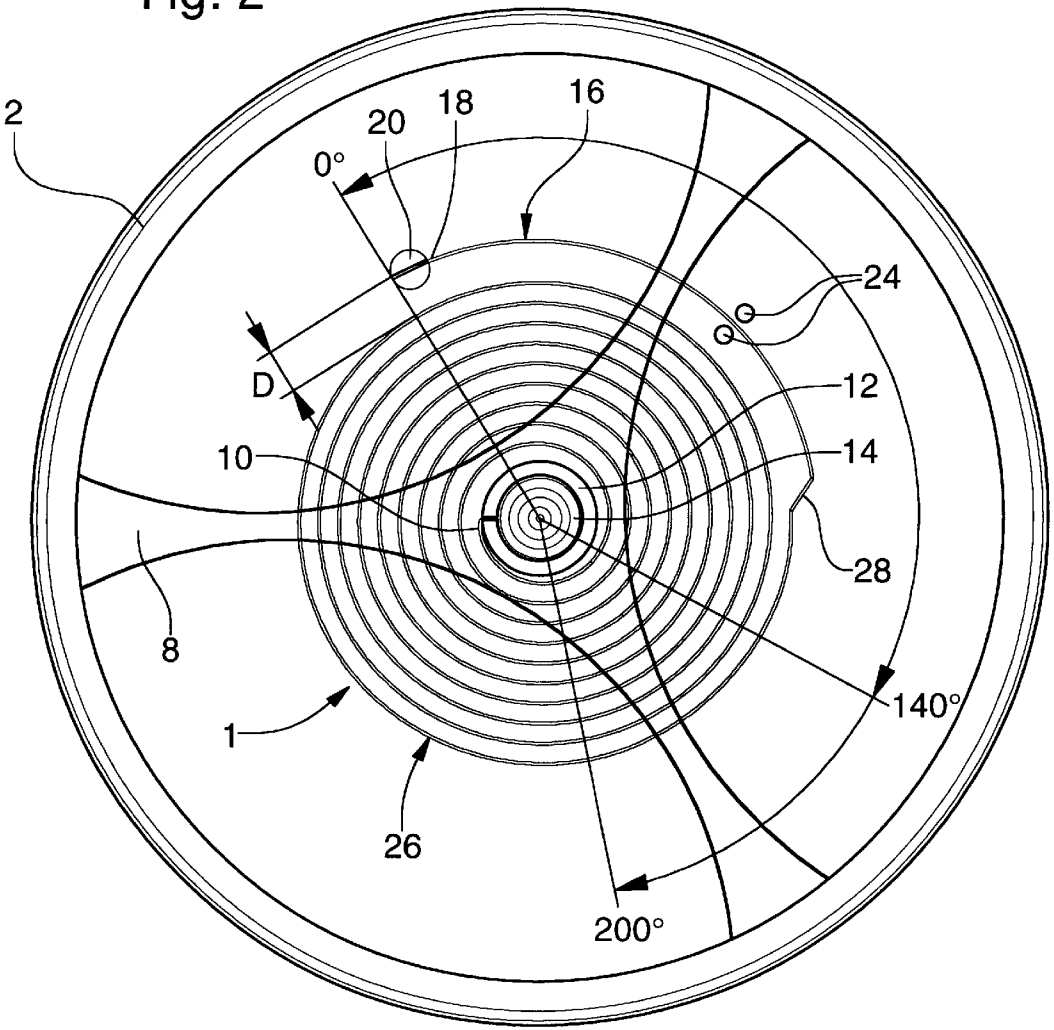

Other features and advantages of the invention will appear more clearly on reading the following description of an embodiment of the invention, given purely by way of illustrative and non limiting example, this description being made in conjunction with the annexed drawings, in which:

FIG. 1 is a perspective view of a regulating assembly including in particular a balance-spring according to the invention; and FIG. 2 is a top view of a balance-spring according to the invention mounted on its balance.

FIG. 1 shows a balance-spring 1 mounted on a balance 2 and intended to form the regulating organ of a clockwork movement (not shown), i.e. the organ which determines the unwinding speed of the gear train leading to the time indicating hands and of which only wheel 4 and escape-pinion 6 are visible in FIG. 1.

In the example shown, balance 2 is formed of a three arm fly-wheel 8. Balance-spring 1 is a wire or metal strip coiled in the shape of a spiral.

It will be noted that the metal used for manufacturing the balance-spring is preferably an allayed steel, for example a ferronickel steel, and that after formation, balance-spring 1 undergoes a first conventional heat treatment to fix the definitive shape and required elastic properties of the spring.

Balance-spring 1 includes an outer end 10 by which it is fixed to a collet 12 adjusted onto an axis of balance 14. Balance-spring 1 includes an incomplete outer turn 16, defining an outer end zone, which ends in an end 18 attached to a stud 20. Stud 20 is attached to a balance bridge 22 fixed to the plate (not shown) of the movement.

The fixing of inner end 10 and outer end 18 of spring 1 is conventional and well known to those skilled in the art and will consequently not be described here in more detail.

Pins 24 of index 26, between which outer turn 16 passes before being fixed to stud 20, are also shown in the Figure.

Outer turn 16 is connected to the preceding turn 26 by a transition zone 28 forming a stair or step extending substantially radially inwards. In the example shown, the radial distance D between outer turn 16 and preceding turn 26 is equal to several pitch of the balance-spring at rest, of course this distance can vary according to the types of spring.

According to the invention, spring 1 is subjected during the manufacturing thereof, to a second localized heat treatment step. More particularly, this additional heat treatment consists in subjecting at least outer turn 16 or the outer end zone of spring 1 to a temperature ranging between 500 and 650° C. and preferably ranging between 510 and 550° C. Advantageously, the treated portion 16 of spring 1 undergoes heating during a sufficient period of time for the aforementioned temperatures to be reached at the core of said portion. Given the small thickness of the wire or the strip forming the spring (generally ranging between 2.5 to 4.5 hundredths of a millimetre), the heating time is very short. After heating, treated turn 16 is air cooled to the ambient temperature.

According to a preferred embodiment of the method of the invention, the portion of spring 1 which undergoes the heat treatment includes transition zone 28 and will generally extend towards the interior of spring 1 beyond outer turn 16 on an arc of a circle less than 200° and preferably on an arc of a circle less than 140° from point of fixation 18 of the stud onto outer turn 16.

The source of heat for the heat treatment advantageously includes a laser beam. The use of a laser beam for the heating operation has in particular the advantage of being able to accurately control the portion of the spring to be heated by controlling the focal point of the beam. In particular, the laser beam can easily be applied in the form of laser pulses of very short duration in the proximity of the portion to be heated in successive points along said portion as is symbolized in the Figure by circles in dotted lines. Typically the duration of each laser pulse is of the order of 0.6 to 0.7 milliseconds. It will be noted in this regard that the laser beam is preferably applied in the region next to the portion of the spring to be treated which is situated on the side of the exterior of spring 1.

It goes without saying that other heating means besides a laser beam can be envisaged by those skilled in the art for this heat treatment. In particular a visible or invisible light source can be provided, such as a sweeping infrared light, a high frequency induction system, a guided micro welding torch or any other means allowing localized heating to be obtained. It will of course be understood that the duration of the heating can vary as a function of the heating means used.

For practical reasons, it is advantageous to mount spring 1 on the balance, without however mounting stud 18, prior to the heat treatment of the spring portion described hereinbefore. It is understood that the reverse can be envisaged and that this heat treatment can be performed at the end of the manufacturing of the spring, the latter delivered to the watch or clockmaker pre-formed and pre-heat treated in the outer end zone, with a view to the conventional mounting thereof on the balance without any other subsequent treatment.

Moreover, the Applicant has observed that the end zone of the spring which has undergone the heat treatment described hereinbefore had a hardness less than that of the rest of the spring, the Vickers hardness measured in this outer end zone being approximately 10% to 15% less than the hardness of the rest of the spring. By way of example, the Vickers hardness measured on the non treated portions of the spring varied from 385 to 395 $HV_{0.025}$ and the Vickers hardness measured on the portions of the same spring treated according to the invention varied from 360 to 375 $HV_{0.025}$.

What is claimed is:

1. A method for manufacturing a balance-spring for a clockwork movement wherein a spring is formed by winding, from a wire or metal strip, said spring including an inner end intended to be fixed to a balance and a outer end zone intended to be fixed to a balance-spring stud and wherein the whole spring is subjected to a first heat treatment subsequent to the winding step of said wire, the method further including an additional step of subjecting at least said outer end zone to a second heat treatment.

2. A manufacturing method according to claim 1, wherein the balance-spring is made of an alloyed steel and the second heat treatment step comprises heating said zone to a temperature ranging between 500 and 650° C. and preferably between 510 and 550° C.

3. A manufacturing method according to claim 1, wherein said zone which undergoes the second heat treatment extends, from the point of fixation of the stud onto the outer turn and towards the interior of the balance-spring on an arc of a circle less than 200° and preferably on an arc of a circle less than 140°.

4. A manufacturing method according to claim 1, wherein the second heat treatment is achieved using a laser beam.

5. A manufacturing method according to claim 4, wherein the laser beam is applied in proximity to said zone, in successive points along said zone.

6. A manufacturing method according to claim 1, wherein said balance-spring is mounted on a balance prior to said second heat treatment.

7. A balance-spring for a clockwork movement formed of a wire or a strip wound in a spiral including an inner end intended to be fixed to a balance and an outer end zone intended to be fixed to a stud, wherein at least said zone has a hardness less than that of the rest of the balance-spring.

8. A balance-spring according to claim 7, wherein the Vickers hardness of the outer end zone is 10% to 15% less than the hardness of the rest of the balance-spring.

9. A balance-spring according to claim 1, being made of a ferronickel steel.

* * * * *